US005901764A

United States Patent [19]

Ritter

[11] Patent Number: 5,901,764

[45] Date of Patent: May 11, 1999

[54] PROTECTIVE COVER FOR TWO BANK CARDS

[76] Inventor: Gerhard Ritter, Bosch-Str. 7, 74193 Schwaigern, Germany

[21] Appl. No.: 08/696,514

[22] Filed: Aug. 14, 1996

[51] Int. Cl.[6] ..... A45C 11/18

[52] U.S. Cl. ..... 150/147; 206/39.5; 206/39.6

[58] Field of Search ..... 206/39.5, 39.6; 150/147

[56] References Cited

U.S. PATENT DOCUMENTS

| | | | |
|---|---|---|---|
| 1,173,843 | 2/1916 | Morten | 206/39.5 X |
| 2,847,118 | 8/1958 | Johnson | 206/39.6 X |
| 4,141,400 | 2/1979 | Mangan | 206/39.6 |

FOREIGN PATENT DOCUMENTS

| | | | |
|---|---|---|---|
| 0121598 | 3/1987 | European Pat. Off. . | |
| 586719 | 3/1994 | European Pat. Off. | 206/39.6 |
| 3926410 | 2/1991 | Germany | 150/147 |
| 9216844 | 2/1993 | Germany | 150/147 |
| 4241642 | 6/1994 | Germany | 206/39 |
| 1595443 | 9/1990 | U.S.S.R. | 206/39.5 |
| 9618320 | 6/1996 | WIPO | 150/147 |

*Primary Examiner*—Sue A. Weaver
*Attorney, Agent, or Firm*—Michael J. Striker

[57] ABSTRACT

A flat, rectangular protective sleeve for receiving two superimposed bank cards or the like has an inner space subdivided into an upper and lower receiving regions for corresponding cards with a gripping opening for the upper receiving region and a gripping opening for a lower receiving region, wherein the upper gripping opening is located at a small distance from one longitudinal edge and the lower gripping opening is located at a small distance from another longitudinal edge so that on the plane view the gripping openings do not overlap one another.

9 Claims, 1 Drawing Sheet

PROTECTIVE COVER FOR TWO BANK CARDS

BACKGROUND OF THE INVENTION

The present invention relates to a protective cover for two bank cards.

More particularly, it relates to a flat, rectangular protective cover which is injection molded as a one-piece element of synthetic plastic material and has a receiving space for two super imposed bank cards or similar flat cards.

Protective covers of the above mentioned general type are known in the art. One of such protective covers is described in the European Patent Document EP-B1-121 598. This patent document discloses a protective cover for one bank card, composed as a one-piece injection molded synthetic plastic part. In this patent, in FIGS. 6–8 and in the associated description a protective cover for two superimposed bank cards is also disclosed. The gripping openings for each of the both bank cards are formed so that on a plane view they overlap one another, whereby the gripping openings are located in the central region of the flat sides of the protective sleeve. The overlapping arrangement of the gripping openings is considered in this document as indispensable, in order to reliably hold the slider which forms the receiving space for the bank cards, during the injection molding process. For holding the slider also small holding openings are distributed in the edge region, and holding pins of the injection molding tool which are in alignment in pairs with one another can hold the slider from above and from below during the injection molding process. Thereby the aligned holding openings are produced in the finished protective cover.

SUMMARY OF THE INVENTION

Accordingly, it is an object of the present invention to provide a protective sleeve for two bank cards, which is a further improvement of the existing protective sleeve of these type.

More particularly, it is an object of present invention to provide a protective sleeve for two bank cards or the like, in which the gripping openings for the inserted bank cards can be arranged in the edge region.

In keeping with these objects with others which will become apparent hereinafter, one feature of the present invention resides, briefly stated, in the protective cover in which the gripping openings provided for displacing a bank card from the protective cover are located not in alignment with one another but instead at a distance laterally offset from one another, so that one gripping opening is located near one longitudinal edge and another gripping opening is located near another longitudinal edge.

Since the gripping openings have a substantially great surface, it is no longer necessary to arrange them in alignment over one another for fixing the inserted slider, when in the edge region in the prior art the holding openings were arranged in pairs in alignment with one another.

Therefore a greater surface for writing than in the prior art is provided. Since protective covers are used by banks and other credit institutions as advertising carriers, the great surface available for writing is an important advantage over the prior art. Moreover the offset arrangement of the gripping surfaces in the edge regions provides an optimal protection for coding or magnetic strips arranged on the bank cards, since a greater corresponding surface of the inserted bank cards is covered by the flat sides of the protective cover.

The receiving space of the protective cover can be subdivided into an upper and lower receiving regions by a web extending along the longitudinal edges inside the cover. The web can be formed as a flat tongue extending parallel to the flat sides of the protective cover and coming to or at least close to the holding openings located in the edge region. The holding openings can be offset inwardly from the outer edge by approximately 2.5–5 mm and the tongue-shaped web can have a width of approximately 1.5–4 mm. The holding openings are therefore inwardly offset from the outer edges of the protective cover when compared with the prior art. Thereby an exact positioning of the slider of the injection molding tool inserted in the receiving space during the injection molding process is improved.

The tongues can have a thickness of approximately 0.5 mm. Thereby a sufficient distance between the superimposed bank card is provided. Depending on the application and changing requirements, naturally the thickness of the tongues can be selected greater to provide a greater distance between the inserted bank cards and the like.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
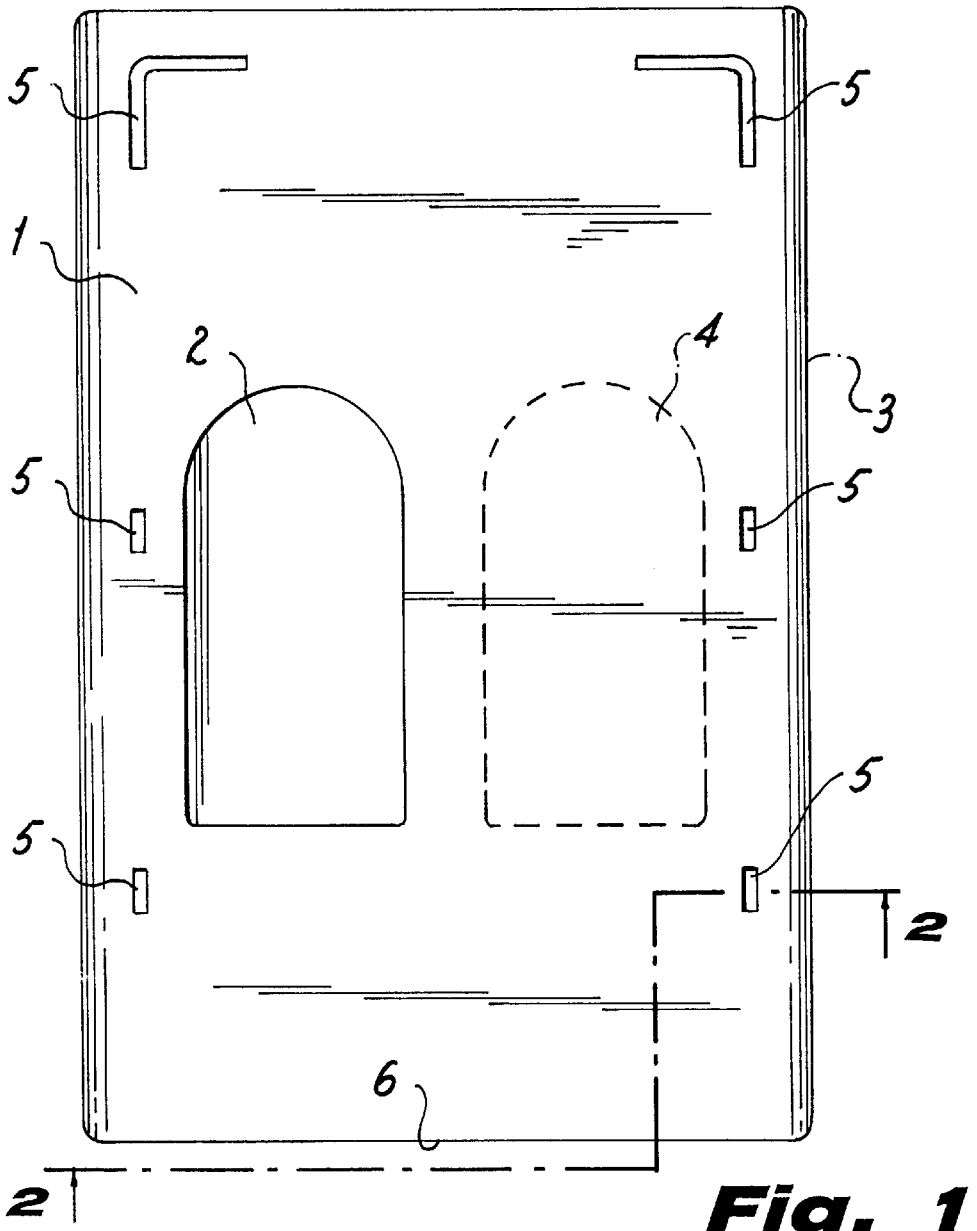
FIG. 1 is a plan view of a protective cover for bank cards in accordance with the present invention.

A protective cover shown in FIG. 1 is used for two bank cards and the like. It can be composed, for example of a transparent synthetic plastic material such as for example ABC or another polystyrol. The inventive protective cover for bank cards and the like has a visible upper wall 1 and an invisible lower flat wall 3. One gripping opening 2 is located in a left edge region of the visible upper wall 1, while another gripping opening 4 shown in broken lines is located in the invisible lower flat wall 3. As can be seen from FIG. 1, the gripping openings 2 and 4 are offset relative to one another so that one of the gripping openings is located near one longitudinal edge of the protective cover, while the other gripping opening is located near the other longitudinal edge of the protective cover. The gripping openings do not overlap one another.

Holding openings 5 are formed in the upper wall 1 and in the lower wall 3 of the protective sleeve and arranged at a distance from the outer edges of the protective cover. The holding openings 5 are arranged in pairs and in alignment with one another in a vertical direction as shown in FIG. 2.

The protective sleeve has an end side 6 facing downwardly in FIG. 1. An insertion and withdrawal opening is formed in the end side 6 for insertion of the bank cards into an inner receiving space 7 of the protective cover or withdrawing the bank cards from the receiving space.

Figure 2:
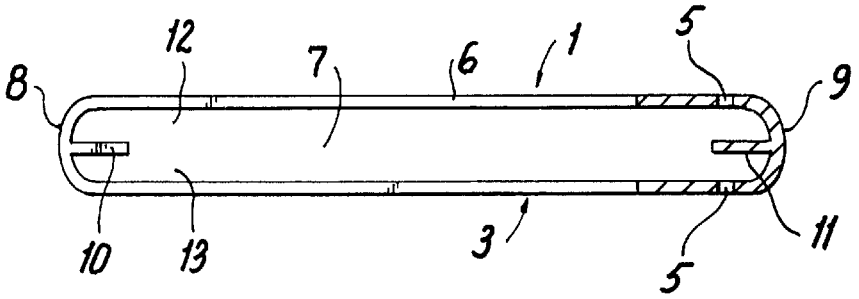
FIG. 2 is a view showing a section 2—2 of the inventive protective cover for bank cards of FIG. 1.

FIG. 2 shows the open end side 6 and in particular the receiving space 7. The protective sleeve is provided with inwardly projecting tongues 10 and 11 arranged at the longitudinal edges 8 and 9. The tongues 10 and 11 extend parallel to the upper wall 1 and the lower wall 3. Also, they extend close to the holding openings 5. The tongues 10 and 11 separate the receiving space 7 into an upper receiving region 12 and a lower receiving region 13. Each receiving region 12, 13 can receive one bank card or the like which is not shown in the drawings. FIG. 2 clearly shows the holding openings 5 which are arranged in pairs and aligned with one another in a vertical direction of FIG. 2.

The holding openings 5 are preferably offset from the longitudinal edges of the protective cover by substantially 2.5–5 mm. The tongues 10 and 11 which extend into the recieving space of the protective cover and preferably have a width of substantially 1.5–4 mm. Their thickness is preferably equal to substantially 0.5 mm. The protective cover as a whole can have a thickness of substantially 5 mm.

The article shown in the drawings is a protective cover for bank cards in accordance with the suggested use. However, also other applications and corresponding embodiments of the inventive protective sleeve are possible.

It will be understood that each of the elements described above, or two or more together, may also find a useful application in other types of constructions differing from the types described above.

While the invention has been illustrated and described as embodied in protective cover for two bank cards, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A protective cover for two superposed bank cards, comprising a substantially flat, rectangular hollow body part forming an inner receiving space, said body part having two longitudinal edges; means for subdividing said inner receiving space into an upper receiving region and a lower receiving region for a corresponding one of the bank cards so that the bank cards can be inserted through an open end side into a corresponding one of said receiving regions; and means for gripping the bank cards and including a first gripping opening provided for one of said receiving regions and a second gripping opening provided for another of said receiving regions; one of said gripping openings being located at a relatively small distance from one of said longitudinal edges while the other of said gripping openings is located at the substantially small distance from another of said longitudinal edges of said body part so that said gripping openings on a plan view do not overlap; and means for subdividing said inner receiving space into an upper receiving region and a lower receiving region for a corresponding one of the bank cards, so that the bank cards can be inserted through an open end side with a corresponding one of said receiving regions, said subdividing means including short tongue means extending exclusively along said longitudinal edges, said gripping openings being located outside said tongue means on a plan view of the cover.

2. A protective cover as defined in claim 1, wherein said body part has an upper wall and a lower wall, one of said gripping openings being provided in one of said walls while the other of said gripping openings is provided in the other of said walls.

3. A protective cover as defined in claim 1; and further comprising a holding means including holding openings arranged in an edge region of said body part, said body part having an upper wall and a lower wall, said holding openings being provided in said upper and lower walls and being in alignment with one another in a substantially vertical direction.

4. A protective cover as defined in claim 1, wherein said short tongue means are defined by webs extending along said longitudinal edges.

5. A protective cover as defined in claim 4, wherein said body part has flat upper and lower walls, said webs are formed as flat tongues extending parallel to said walls.

6. A protective cover as defined in claim 5, wherein said body part has upper and lower holding openings, said tongues extending at least close to said holding openings.

7. A protective cover as defined in claim 1, wherein said body part has upper and lower walls; and further comprising holding means including holding openings which are offset from said longitudinal edges by substantially 2.5–5 mm; said tongue means extending into said inner space and having a width of substantially 1.5–4 mm.

8. A protective cover as defined in claim 1, wherein said tongues means have a thickness of substantially 0.5 mm, said body part being used for two bank cards and having a thickness amounting to substantially 5 mm.

9. A protective cover for two superposed bank cards, comprising a substantially flat, rectangular hollow body part which has a longer length and a shorter width and forms an inner receiving space, said body having two longitudinal edges extending in a longitudinal direction and spaced from one another in a transverse direction; means for subdividing said inner receiving space into an upper receiving region and a lower receiving region for a corresponding one of the bank cards, so that the bank cards can be inserted through an open end side with a corresponding one of said receiving regions, said subdividing means including short tongue means extending exclusively along said longitudinal edges, said receiving regions having substantially identical lengths in said longitudinal direction and substantially identical widths in said transverse direction; and means for gripping the bank cards and including a first gripping opening provided for one of said receiving regions at one side of said body part and a second gripping opening provided for another of said receiving region at another side of said body part, one of said gripping openings being located at a relatively small distance from one of said longitudinal edges while the other of said gripping openings is located at a relatively small distance from another of said longitudinal edges of said body part, said gripping openings being elongated at said longitudinal direction of said body parts and extend over a same region in said longitudinal direction, and at the same time being spaced from one another in said transverse direction so as not to overlap one another in said transverse direction on a plan view; and holding means including holding openings arranged in an edge region of said body part, said body part having an upper wall and a lower wall, said holding openings being provided in said upper and lower walls and being in alignment with one another in a substantially vertical direction, said gripping openings being located outside said tongue means on a plan view of the cover.

* * * * *